US006294243B1

(12) United States Patent
Nakamura

(10) Patent No.: US 6,294,243 B1
(45) Date of Patent: Sep. 25, 2001

(54) INK JET RECORDING SHEET

(75) Inventor: Atsushi Nakamura, Tokyo (JP)

(73) Assignee: Nisshinbo Industries, Inc., Tokyo (JP)

( * ) Notice: Subject to any disclaimer, the term of this patent is extended or adjusted under 35 U.S.C. 154(b) by 0 days.

(21) Appl. No.: 09/197,417

(22) Filed: Nov. 23, 1998

(30) Foreign Application Priority Data

Dec. 2, 1997 (JP) ..... 9-345762

(51) Int. Cl.[7] ..... B41M 5/00
(52) U.S. Cl. ..... 428/195
(58) Field of Search ..... 428/195, 521, 428/522

(56) References Cited

U.S. PATENT DOCUMENTS 5,989,378 * 11/1999 Liu et al. ..... 156/241

* cited by examiner

*Primary Examiner*—Pamela R. Schwartz
(74) *Attorney, Agent, or Firm*—Garter, Ledyard & Milburn

(57) ABSTRACT

The present invention provides a new ink jet recording sheet being capable forming an excellent printed graphic of an oil ink and being excellent in the fixation and coloration of an oil ink particularly containing a petroleum high-boiling point solvent. The ink jet recording sheet comprises an interlayer 2 and an ink receiving layer 3 on at least one side of a substrate 1 wherein a resin forming the interlayer 2 contains a resin dissolved and/or swollen in a petroleum high-boiling point solvent.

1 Claim, 1 Drawing Sheet

INK JET RECORDING SHEET

BACKGROUND OF THE INVENTION

1. Field of the Invention

The present invention relates to a recording sheet using an oil ink for ink jet recording and in particular to an ink jet recording sheet excellent in the fixation and coloration of an oil ink containing a petroleum high-boiling point solvent.

2. Description of the Related Art

The ink jet recording system is a system where ink droplets are generated and scattered via ink nozzles of an ink jet printer and allowed to adhere to the surface of a recording material, thus forming an graphic recorded thereon. Because of high-speed printing, easy multi-colored printing, suitability for recording a large graphic, silent sound at the time of recording, low running costs etc., the ink jet recording system has attracted particular attention in recent years, and new techniques therefor have extensively been developed.

In development of techniques in this recording system, the ink itself has been developed along with, or independently of, the development of the apparatus with respect to the structure, mechanism etc. of the ink jet printer, and further a recording material suitable for the used ink has been intensively developed.

In respect of the ink, an aqueous ink has been developed preferentially over an oil ink because of often occurring clogging in a nozzle caused by drying in the printer, and a recording material has been developed preferentially for this aqueous ink.

However, an oil ink excellent in characteristics such as dispersion of pigments has been developed recently and simultaneously a printer apparatus suitable for such oil ink has been developed, so the problem of clogging of nozzles described above is now being solved, and therefore particular attention is paid recently to the ink jet recording system using the oil ink.

The recording system using the oil ink has attracted attention for the above reasons and further because a record graphic formed on an ink receiving layer in a recording material is inherently superior in water resistance, thus making it usable as a paper used outdoors, such as poster, billboard and label without particularly subjecting it to water resistance treatment etc.

Because no recording material with superior performance has been developed and provided for the ink jet recording system using the oil ink, a recording material for the aqueous ink is now used.

Such recording materials include an ink jet recording sheet comprising a substrate poor in water absorption provided thereon with a water-soluble polymeric coating layer as an ink jet recording sheet (Japanese Laid-Open Patent Publication No. 146786/1980), a recording sheet comprising a water-non-absorptive substrate provided with an anchor coat layer based on an aqueous copolymer polyester (Japanese Laid-Open Patent Publication No. 46289/1985), and a recording material comprising a substrate provided with an ink-receiving layer via an anchor coat layer insoluble in water-soluble organic solvent (Japanese Laid-Open Patent Publication No. 134285/1987).

However, any recording materials or sheets described above have been developed for the aqueous ink, so if the oil ink is used for recording, absorption of the ink solvent is inferior, thus causing problems such as inadequate printing by flowing of printed graphics.

Further, how the ink solvent is to be treated by absorption etc. in a recording material or a recording sheet is very closely related to ink fixation and coloration in the case of the oil ink as compared with the aqueous ink, but there is no proposal for the recording material and recording sheet to solve such problems.

SUMMARY OF THE INVENTION

Accordingly, in view of the fact that the conventional ink jet recording sheet (recording material) is directed mainly to the aqueous ink as described above, the object of the present invention is to provide a new ink jet recording sheet being capable of forming an excellent printed graphic of the oil ink and being excellent in the fixation and coloration of particularly the oil ink containing a petroleum high-boiling point solvent.

The constitution of the present invention made to solve the problems is a ink jet recording sheet comprising an interlayer and an ink receiving layer on at least one side of a substrate wherein a resin forming the interlayer contains a resin dissolved and/or swollen in a petroleum high-boiling point solvent.

That is, in view of the present circumstances under which a printer apparatus having excellent performance suitable for the oil ink has been developed and provided in the recent ink jet recording system, the present inventors conducted extensive studies for the purpose of developing an ink jet recording sheet which is capable of demonstrating excellent ink fixation and coloration for the oil ink, and as a result, they found that it is very important how the oil-ink solvent can be suitably treated by absorption etc. in the recording sheet, and for this role, the interlayer was selected, and the present invention was thereby completed.

The resin forming the interlayer is a styrene-based resin, a rubber-based resin or a mixture thereof.

Typical examples of the resin forming the interlayer include styrene-butadiene copolymer resin and polynorbornene as rubber-based resin.

DETAILED DESCRIPTION OF THE INVENTION

Figure 1:
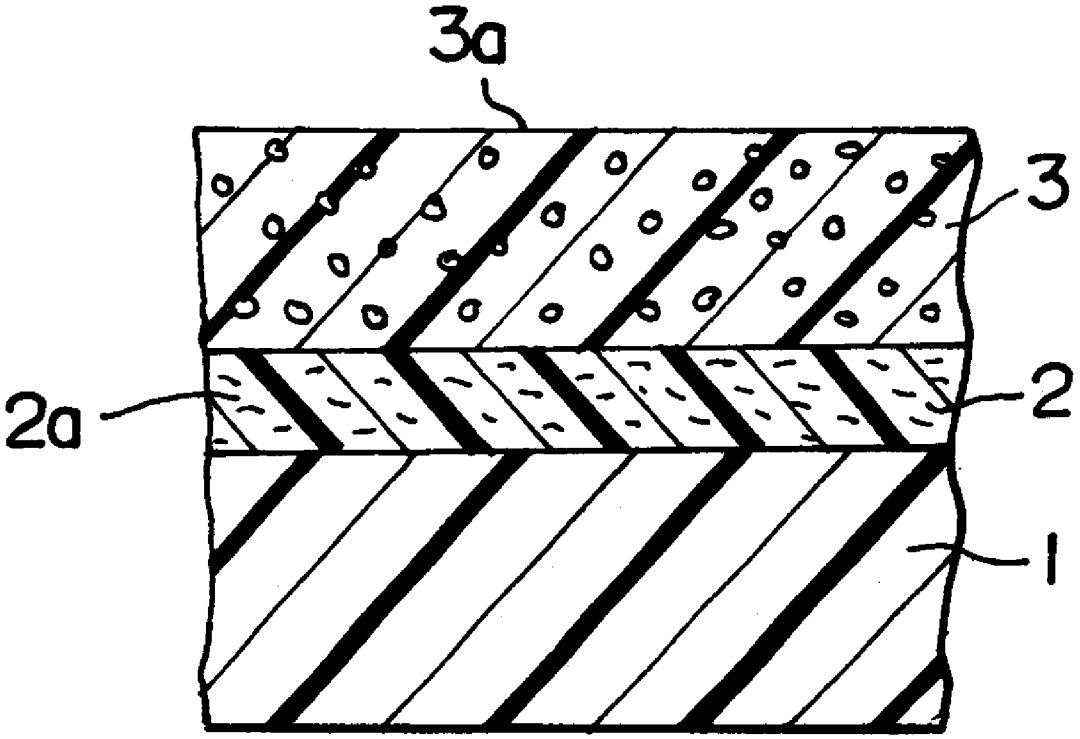
FIG. 1 is a schematic drawing showing the structure of layers in one example of the ink jet recording sheet of the present invention. In this drawing, 1 is the substrate, 2 is the interlayer, and 3 is the ink receiving layer.

Hereinafter, examples of the constitution of the ink jet recording sheet of the present invention are described. FIG. 1 is a schematic sectional view showing the structure of layers in one example of the ink jet recording sheet of the present invention. In FIG. 1, 1 is the substrate, 2 is the interlayer provided on one side of the substrate 1, and 3 is the ink receiving layer provided on the interlayer 2. 2a is an ink solvent absorbed into the interlayer 2, and 3a is a coloring material captured and fixed on the ink receiving layer 3. Although not shown, the interlayer 2 and the ink receiving layer 3 may be provided on both sides of the substrate 1.

Substrate 1 used in the sheet of the present invention include films made of polyethylene terephthalate, polypropylene, polystyrene, polyvinyl chloride, polymethyl methacrylate, polyethylene, polycarbonate etc., foams thereof, or films thereof mixed with inorganic fillers such as calcium carbonate.

The interlayer 2 in the sheet of the present invention consists essentially of a binder resin to which fillers such as silica, titanium oxide etc. may be added to prevent blocking or to improve opaqueness. Further the surface of the interlayer 2 may have been subjected to e.g. corona discharge treatment to improve adhesion to the substrate 1.

The binder resin consisting essentially of the interlayer 2 requires absorbing and maintaining a high-boiling point petroleum solvent as the solvent in the oil ink, and for this requirement, the binder resin should have the property of being dissolved in a high-boiling point petroleum solvent and/or the property of being swollen in a high-boiling point petroleum solvent. Such resin includes styrene-based resin, rubber-based resin etc., and use can be made of styrene-based resin alone, rubber-based resin alone or a mixture containing these resins at a suitable ratio. The resin contained in the interlayer 2 includes e.g. acrylic resin, polyester resin, urethane resin etc. besides styrene-based resin and rubber-based resin.

The styrene-based resin includes styrene alkyd resin, styrene-acrylate copolymer resin or substituted derivatives thereof. The substituted derivatives include those carboxylated or those rendered alkali-reactive.

The rubber-based resin includes styrene-butadiene copolymer resin, acrylonitrile-butadiene copolymer resin, methacrylate-butadiene copolymer resin, acrylonitrile-styrene-butadiene copolymer resin, methacrylate-styrene-butadiene copolymer resin, urethane acrylate rubber, polynorbornene resin or substituted derivatives thereof. The substituted derivatives include e.g. those carboxylated or those rendered alkali-reactive.

The styrene-based resin, rubber-based resin etc. may be used alone or in combination thereof. In particular, styrene-butadiene copolymer resin and polynorbornene resin show the properties of superior solubility in the high-boiling point petroleum solvent and of good swelling in this solvent. The high-boiling point petroleum solvent as the solvent in the oil ink is preferably isoparaffin, paraffin etc.

The role of this interlayer 2 is as follows: The solvent in the ink received by the ink receiving layer 3 described in detail below migrates through the ink receiving layer 3 and reaches this interlayer 2 where the solvent is absorbed, so the absorption of the ink into the recording sheet as a whole is improved and simultaneously the fixation of dyes and pigments in the ink receiving layer 3 can be made strong and stable due to the role of the interlayer 2.

The thickness of the interlayer 2 is preferably about 1 to 10 $\mu$m, more preferably about 2 to 8 $\mu$m, but this thickness can be varied suitably depending. on the type of the ink solvent and the amount of the absorbed ink. Here, the interlayer 2 is composed of one layer, but can be composed of two or more layers made of one or more resins selected from styrene-based resin, rubber-based resin etc.

Then, the ink receiving layer 3 in the sheet of the present invention consists essentially of a binder resin and fillers, which is a layer having a sufficiently porous surface layer suitable for absorption of the ink. The thickness of this ink receiving layer 3 is preferably about 10 to 60 $\mu$m, more preferably about 20 to 50 $\mu$m.

The binder resin constituting the ink receiving layer 3 includes resins such as polyvinyl alcohol, polyvinyl pyrrolidone, acrylic copolymer, acrylate, ethylene-vinyl acetate copolymer etc. A highly lipophilic resin is preferable.

The fillers constituting the ink receiving layer 3 can employ inorganic fillers and organic fillers, and the inorganic fillers include synthetic silica, diatomaceous earth, calcium carbonate, kaolin etc., and the organic fillers include styrene, methacrylate beads etc.

Embodiments of the sheet of the present invention are as described above, and in the present invention, the method of providing the interlayer on the substrate 1 and the ink-receiving layer on the interlayer can make use of an application system known in the art, such as reverse roll coating, air knife coating, gravure coating, blade coating etc.

Because the solvent in the oil ink can be absorbed into the interlayer in the ink jet recording sheet of the present invention thus obtained, coloring materials such as pigments and dyestuffs can be fixed strongly and stably in the ink receiving layer. Accordingly, the coloring materials are not transferred with the transfer of the solvent, so there are the unique effects that the printed graphic is not broken and the graphic excellent in coloration can be obtained due to the strong and stable fixation of the ink.

Further, the ink jet recording sheet of the present invention forms a printed graphic of the oil ink on the surface thereof, so the water resistance of the graphic is high, and the sheet can be used preferably outdoors as a label, poster, billboard etc.

EXAMPLES

Hereinafter, the ink jet recording sheet of the present invention is described with reference to Examples and Comparative Examples, and evaluation results are shown.

Example 1

As the substrate, a transparent polyester film of 100 $\mu$m in thickness (A8300, Toyobo Co., Ltd.) was used. As the interlayer, a solution of 100 parts by weight of an styrene-butadiene copolymer resin (Toughbrene 912, Asahi Chemical Industry Co., Ltd.) in 400 parts by weight of toluene was applied by a reverse roll coater to one side of said substrate to form a coating of 5 $\mu$m in thickness after drying. Then, 15 parts by weight of calcined kaolin (Altowhite TE, Georgia Kaolin) and 23 parts by weight of diatomaceous earth (Ratiolite F, Showa Kagaku K. K.) were added as pigments to 30 parts by weight of an acrylate copolymer binder (EL Polymer WS-50AC-11 with a solid content of 36%, Shin Nakamura Kagaku K. K.), then sufficiently stirred and dispersed by a sand grinder, and applied as the ink receiving layer to the above interlayer on the substrate to form a coating of 45 $\mu$m in thickness after drying, to give the ink jet recording sheet of the present invention.

Example 2

The ink jet recording sheet was obtained in the same manner as in Example 1 except that as the interlayer, 400 parts by weight of toluene were added to 100 parts by weight of a polynorbornene resin solution (Norsolex NSX-L with 1% solid content, Zeon Kasei K. K.) and mixed well and applied by a reverse roll coater to form a coating of 5 $\mu$m in thickness after drying.

Example 3

The ink jet recording sheet of the present invention was obtained in the same manner as in Example 1 except that as the interlayer, acrylic-styrene copolymer resin (Mowinyl 880 with a solid content of 47%, Hoechst Gosei Co., Ltd.) was applied by a reverse roll coater to form a coating in 5 $\mu$m in thickness after drying.

Example 4

As the substrate, a white foamed polyester film of 100 $\mu$m in thickness (Crisper G2323, Toyoboseki) was used. As the interlayer, a solution of 100 parts by weight of an styrene-butadiene copolymer resin (Toughbrene 912, Asahi Chemical Industry Co., Ltd.) in 400 parts by weight of toluene was applied to one side of the substrate to form a coating of 5 μm in thickness after drying. Then, 12 parts by weight of synthetic amorphous silica (Mizukasurubu C-1, Mizusawakagaku K. K.) were added to 34 parts by weight of an acrylate copolymer binder (EL polymer WS-50AC-11 with a solid content of 36%, Shin Nakamura Kagaku K. K.) and mixed sufficiently and dispersed by a sand grinder and applied as the ink receiving layer by a reverse roll coater to the above interlayer on the substrate to form a coating of 40 μm in thickness after drying, to give the ink jet record sheet of the present invention.

Comparative Example 1

An ink jet recording sheet was obtained in the same manner as in Example 1 except that as the interlayer, a colloidal silica composite particle emulsion (Mowinyl 8020 with a solid content of 43%, Hoechst Gosei Co., Ltd.) was applied by a reverse roll coater to form a coating in 5 μm in thickness after drying.

Comparative Example 2

An ink jet recording sheet was obtained in the same manner as in Example 4 except that as the interlayer, a saturated polyester binder (Byronal MD-1200 with a solid content of 33%, Toyobo Co., Ltd.) was applied by a reverse roll coater to form a coating in 5 μm in thickness after drying.

The ink jet recording sheets obtained in Examples 1 to 4 and Comparative Examples 1 and 2 were evaluated as follows.

Evaluation Methods (1) Density of a printed graphic

An graphic of an oil pigment ink (cyan) was printed using a commercial ink jet printer and the density of the graphic was measured by a Macbeth RD-918 reflection densitometer.

(2) Ink oozing

After an graphic of oil pigment inks (cyan and magenta) was printed by printing said inks repeatedly, ink oozing was evaluated with the eyes.

(3) Ink-solvent oozing

Oily pigment inks (cyan) and (magenta) were printed by printing said inks repeatedly, and 24 hours later, ink-solvent oozing around the printed portion was evaluated with the eyes.

Evaluation Results

The ink jet recording sheets obtained in Examples 1 to 4 indicated neither ink oozing nor ink-solvent oozing, while the ink jet recording sheets obtained in Comparative Examples 1 and 2 indicated ink oozing and ink-solvent oozing.

This is because in the ink jet recording sheets obtained in Comparative Examples 1 and 2, the interlayer hardly absorbs the ink solvent so the ink solvent is stored in the ink receiving layer, thus deteriorating the fixation of the coloring materials in the ink receiving layer.

For example, in the ink jet recording sheets obtained in Comparative Examples 1 and 2, the ink solvent stored in the ink receiving layer oozes on the surface of the receiving layer, thus making the graphic blurred.

The evaluation results described above are shown in Table 1.

TABLE 1

| | (1) Graphicdensity: cyan (Note 1) | (2) Ink oozing (Note 2) | (3) Ink-solvent oozing (Note 3) |
|---|---|---|---|
| Example 1 | ○ (1.17) | ○ | ○ |
| Example 2 | ○ (1.16) | ○ | ○ |
| Example 3 | ○ (1.15) | ○ | ○ |
| Example 4 | ○ (1.15) | ○ | ○ |
| Comparative Example 1 | × (1.12) | × | ○ |
| Comparative Example 2 | × (1.13) | × | × |

(Note 1) Number in the parentheses indicates the density of the printed graphic. 1.14 or more was assigned ○, and less than 1.14 was assigned X.

(Note 2) ○ indicates no ink oozing, and X indicates ink oozing.

(Note 3) ○ indicates no ink-solvent oozing, and X indicates ink-solvent oozing.

What is claimed is:

1. An ink jet recording sheet for use with an oil based ink containing a high boiling point solvent, comprising:

(a) a receiving layer; and (b) a substrate; and (c) an interlayer disposed between said receiving layer and said substrate, said interlayer containing polynorborene for promoting migration of the solvent of an oil based ink through said receiving layer into said interlayer leaving the colorant of the oil based ink on said receiving layer.

* * * * *